United States Patent [19]

Puckett et al.

[11] 4,420,844

[45] Dec. 20, 1983

[54] VANDAL RESISTANT DRAIN STOPPER

[75] Inventors: William E. Puckett, Kirkland, Wash.; Wanda F. Baird; Richard C. Chappell, both of Downey, Calif.

[73] Assignee: Rapid Fit Enterprises, Inc., Bell Gardens, Calif.

[21] Appl. No.: 442,644

[22] Filed: Nov. 18, 1982

[51] Int. Cl.[3] ..... A47K 1/14

[52] U.S. Cl. ..... 4/295; 4/286

[58] Field of Search ..... 4/286–295; 220/36 AT, 284, 285; 137/385; 138/89; 285/81, 91

[56] References Cited

U.S. PATENT DOCUMENTS

| | | | |
|---|---|---|---|
| 2,145,759 | 1/1939 | Fellows et al. | 220/86 AT |
| 3,771,177 | 11/1973 | Rogers et al. | 4/287 |
| 3,849,809 | 11/1974 | Morris et al. | 4/295 |

*Primary Examiner*—Stephen Marcus
*Assistant Examiner*—Kenneth S. Putnam
*Attorney, Agent, or Firm*—Blakely, Sokoloff, Taylor & Zafman

[57] ABSTRACT

An improved drain valve is disclosed for selectively sealing a conduit. The drain valve comprises a drain housing installed in a bathtub or the like, latching means threadedly coupled to the housing and a combination drain stopper and actuator coupled to the latching means. A locking member coupled to the latching means is adapted to allow the latching means to threadedly engage the drain housing, but prevent disengagement therefrom, without the use of a tool specially made to release the locking member. Upon release of the locking member by use of the tool, the latching means and combination drain stopper and actuator may be disengaged from the housing.

18 Claims, 12 Drawing Figures

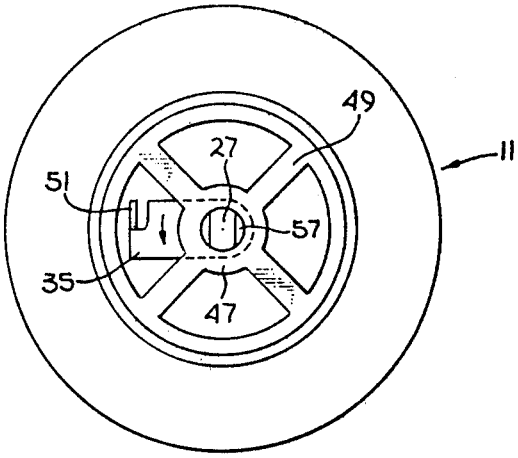
Fig. 4
Fig. 5
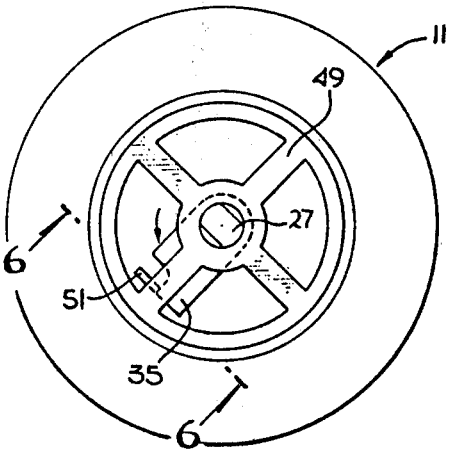
Fig. 6
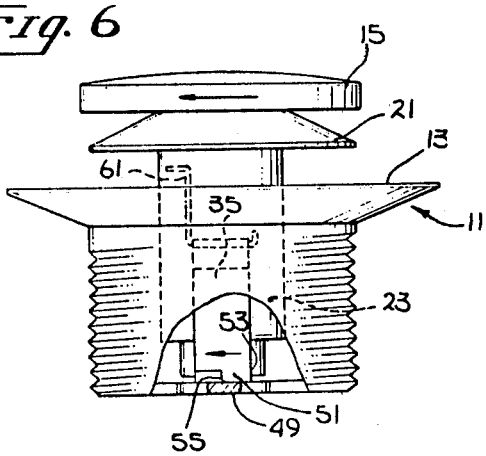
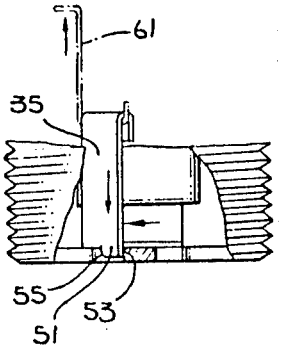
Fig. 7
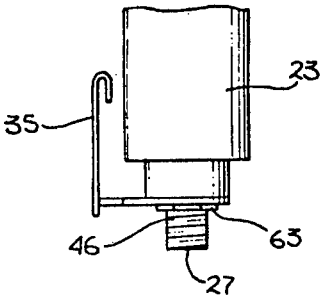
Fig. 10

VANDAL RESISTANT DRAIN STOPPER

PRIOR ART STATEMENT

Self-contained drain valves are well-known devices frequently used in bathtubs, sinks and the like in hotels, restaurants, and other public facilities as well as in private residences. See, for example, the self-contained drain valve described in U.S. Pat. No. 3,771,177. Such self-contained drain valves comprise a combination drain stopper and actuator, and a drain housing. The actuator is coupled to a latching member having a threaded central post at one end. The threaded end of the central post threads onto mating threads at an end of the housing. The actuator and latching member may be removed from the housing by simply unscrewing the actuator from the housing and removing the actuator and latching member from the housing. This ease of removal enable vandals to unscrew and remove the actuator making necessary the frequent replacement of the actuators in certain hotels and other public places subject to vandalism.

BRIEF SUMMARY OF THE INVENTION

An improved drain valve is disclosed for selectively sealing a conduit. The drain valve comprises a drain housing installed in a bathtub or the like, latching means threadedly coupled to the housing and a combination drain stopper and actuator coupled to the latching means. A locking member coupled to the latching means is adapted to allow the latching means to threadedly engage the drain housing, but prevent disengagement therefrom, without the use of a tool specially made to release the locking member. Upon release of the locking member by use of the tool, the latching means and combination drain stopper and actuator may be disengaged from the housing.

The use of drain valves which employ the improvements taught by the subject invention in hotels, motels and other public places will enable authorized personnel who have the aforementioned tool to remove the combination drain stopper and actuator, and latching means from the housing for clearing clogged drains and the like. However, vandals and other unauthorized persons would be unable to remove the combination drain stopper and actuator, and latching means from the housing.

BRIEF DESCRIPTION OF THE DRAWINGS

FIG. 4 is a plan view of the bottom end of the housing taken along line 4—4 of FIG. 2 showing a first embodiment of the locking member.

FIG. 5 is a cross-section view taken along line 5—5 of FIG. 2 showing a first embodiment of the locking member.

FIG. 6 is an elevation view of the drain valve in partial cutaway showing the rounded edge of a first embodiment of the locking member riding over a spoke of the housing.

FIG. 7 is a view similar to FIG. 6 showing the locking member being released to allow the actuator to be unscrewed from the housing.

FIG. 10 is a partial elevation view of the latching post showing the locking member coupled to the latching post by a lock washer.

DETAILED DESCRIPTION OF THE INVENTION

An improved, self-contained drain valve is disclosed for selectively sealing a conduit. The drain valve includes a combination drain stopper and actuator coupled to latching means which may be threadedly engage within a drain housing adapted for mounting in a tub or sink. A locking member coupled to the latching means makes removal of the actuator and latching means from the housing by unscrewing the actuator extremely difficult without the use of a tool adapted to first release the locking member before unscrewing the actuator.

Figure 1:
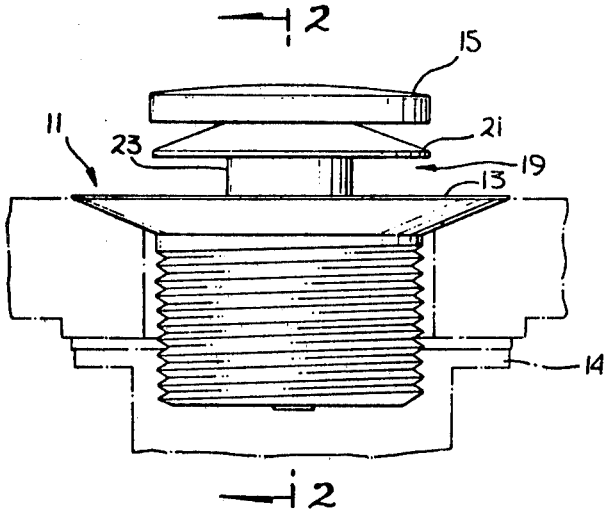
FIG. 1 is an elevation view of the drain valve with the actuator in an unseated position.

Referring to FIG. 1, the drain valve 11 of the subject invention is shown. The drain valve 11 comprises a combination drain stopper and actuator 15 and housing 13 mounted within a tub 14 or sink by, for example, threaded engagement. The combination drain stopper and actuator will hereinafter be referred to as the actuator. When the actuator 15 is in an unseated position, a sealing skirt 21 adjacent the actuator is spaced apart from the top or sealing surface of housing 13. Thus, water or other fluid flows past the actuator 15 and skirt 21 and into a conduit and is thereby drained from the tub or sink in which the drain valve 11 is mounted. Resilient member 19 comprised of skirt 15 and tubular portion 23 extends from the skirt 21 in a direction opposite from the actuator.

Figure 2:
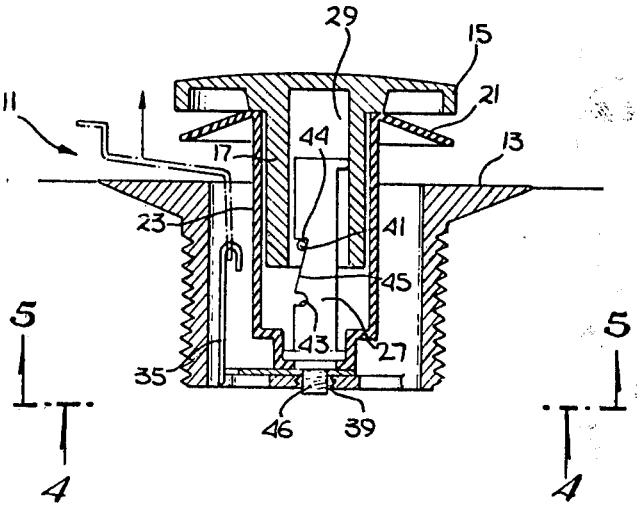
FIG. 2 is a cross-section view of the drain valve taken along line 2—2 of FIG. 1.
Figure 3:
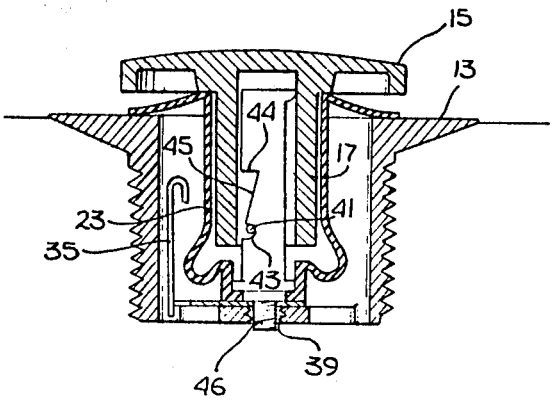
FIG. 3 is a view similar to FIG. 2 except showing the actuator in a seated position.

Further details of the operation of the drain valve 11 of the subject invention may best be described in conjunction with FIGS. 2 and 3. The tubular portion 23 of resilient member 19 extends into housing 13 and acts to keep actuator 15 spaced apart from housing 13. Actuator 15 has a tubular projection 17 which extends into tubular portion 23. The interior of tubular projection 17 has an opening 29 for receiving a latching means as described below. The latching means is threadedly coupled to the drain housing 13 and as such is stationary with respect to the housing. Thus, the only moving parts of the drain valve are the actuator 15 itself and tubular projection 23 which is coupled to and moves with the actuator.

The latching means comprises a latching post 27 having a latching notch 43 disposed near the end of the post most distant from the actuator 15, a stop ramp 45 disposed near the end of the post closest to the actuator and a threaded end 46 disposed at the end of the post most distant from the actuator. A pin 41 coupled to an end of tubular projection 17 most distant from the actuator 15 engages a horizontal surface 44 of latching post 27 formed by stop ramp 45 thereby preventing separation of the latching post from actuator 15 by pulling the actuator out of the housing. Downward pressure on actuator 15 compresses resiliant tubular portion 23 and causes pin 41 to slide down stop ramp 45 until the pin engages latching notch 43 which occurs at approximately the same time that the sealing skirt 21 engages the top surface or sealing surface of housing 13 forming a fluid resistant seal between the actuator-skirt combination and the housing. Latching notch 43 holds pin 41 thereby holding actuator 15 in a seated or sealing position. Pressing down on an edge of actuator 15 most distant from the pin 41 causes the pin to pivot out of the latching notch 43 and the force of compressed resiliant tubular portion 23 causes the sealing skirt 23 to move away from the sealing surface of housing 13 until the upward movement of the pin is stopped by the horizontal surface 44 formed by the stop ramp 45.

Instead of resilient member 19, a spring or other resilient means could be inserted in opening 29 prior to inserting the latching post 27 as a means for keeping actuator 15 unseated until such time as downward pressure is applied to the actuator and pin 41 is engaged by latching notch 43. See also U.S. Pat. No. 3,428,295 which issued Feb. 18, 1969, which shows the use of springs as a means to keep the actuator unseated.

Additionally, as may be seen in FIG. 2 or 3, the latching post 27 is held within housing 13 by engaging threads 39. Referring to FIG. 4, it will be noted that threads 39 are tooled into a hub 47. Hub 47 is held by spokes 49 which extend radially from an end of housing 13 at its perimeter to hub 47. It will be appreciated that latching post 27 and opening 29 are cooperatively proportioned to enable the latching post to freely slide in vertical relation with respect to the opening, but rotational movement between the latching post and the opening is inhibited. For example, both the opening and the latching post may be substantially rectangularly shaped to prevent such rotational movement. Thus, an installer by turning actuator 15 in a clockwise direction transmits rotational movement to the end of latching post 27 which is threaded and received by threads 39 within hub 47. Similarly, the actuator and latching post may be removed by turning the actuator in a counter-clockwise direction.

While it is desirable to be able to easily install the actuator and latching means within the housing, it is also desirable to have means to prevent removal of the actuator and latching means by vandals and the like, and yet have means readily available for removing the actuator and latching means in the event the drain in which the valve is installed is clogged or in need of other plumbing services.

In that regard, referring now to FIGS. 4 through 8, a first embodiment of the locking member 35 of the subject invention will now be described. The locking member 35 comprises an approximately L-shaped stiffly resilient member. Appropriate materials which may be used for the L-shaped member include spring steel, brass, stainless steel or a plastic such as nylon ABS. An approximately oblong opening 57 is disposed at an end of one leg 58 of the locking member 35. The opening 57 should have at least one and preferably two flat sides. The threaded end 46 of latching post 27 is cut such that at lest one side of the threaded end is flat and cooperatively proportioned such that oblong opening 57 will fit thereon such that locking member 35 cannot move rotationally with respect to the latching post 27. An end of the other leg 60 of locking member 35 has a hook 59 as described more fully below.

The approximately right angle junction of the two legs of locking member 35 comprises a stop flange 51 which extends from the leg which has hook 59 such that the stop flange will engage (or ride over, depending on the direction of rotation) spokes 49 as latching post 27 is rotated within the housing 13 for threaded engagement of the latching post with threads 39. Stop flange 51 comprises a flat edge 53 and a rounded edge 55. The rounded edge 55 is disposed on a side of stop flange 51 such that when actuator 15 is turned in a clockwise direction to thread the latching post 27, the rounded edge of stop flange 51 rides over spokes 49 as the rounded edge hits each of the spokes. However, when actuator 15 is turned in a counter-clockwise direction so as to threadedly disengage latching post 27 from housing 13, the flat edge 53 of stop flange 51 engages one of the spokes 49 prior to the completion of a 90 degree counter-clockwise rotation, thereby preventing removal of the actuator 15 from the housing 13. The stiff resilience of locking member 35 causes the locking member to retain its approximate L-shaped despite distentions in the member caused by stop flange 51 riding over spokes 49 when the actuator is turned in a clockwise direction.

Of course, means other than the radial spokes may be employed to engage stop flange 51 during counter-clockwise rotation of the actuator. For example, in place of radial spokes 49, a grid structure may be utilized to hold hub 47 in place and engage the stop flange 51. Alternatively, one or more projections from the interior wall of the drain housing 13 may also be used to engage the stop flange 51 during counter-clockwise rotation.

Figure 8:
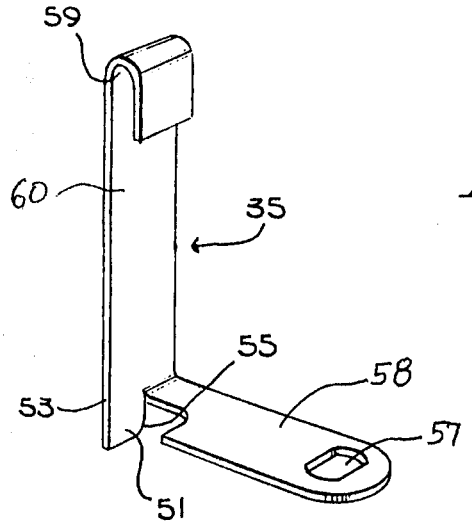
FIG. 8 is a perspective view of the first embodiment to the locking member.
Figure 9:
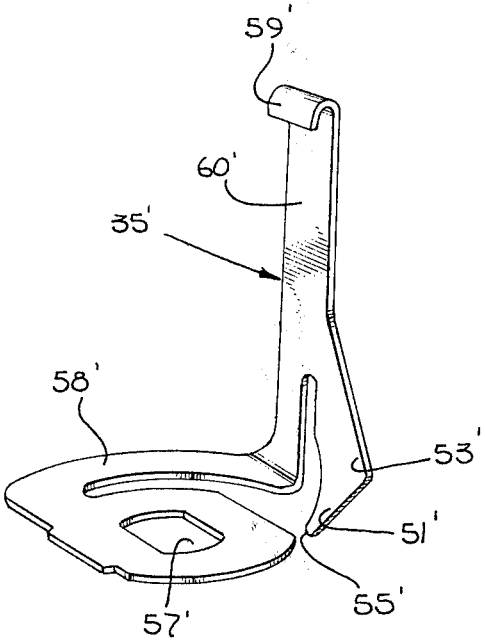
FIG. 9 is a perspective view of a second embodiment of the locking member.

In addition to the locking member 35 as above-described and shown, in a perspective view in FIG. 8, another embodiment of a locking member 35', shown in a perspective view in FIG. 9, will now be described.

Locking member 35', while different in structure than locking member 35, functions in a similar manner as locking member 35 as above-described. The structural differences between the two locking members lie mainly in the shape of stop flange 51' (stop flange 51 in locking member 35). In flange 51', instead of a flat edge 53 and rounded edge 55, there are two curved edges 53' and 55' shaped such that edge 53' engages spokes 49 when actuator 15 is turned in a counter-clockwise direction, and edge 55' rides over spokes 49 when actuator 15 is turned in a clockwise direction. Additionally, leg 58' of locking member 35' which has opening 57' for engaging latching post 27, forms a curved section between opening 57' and the junction with leg 60'. The corresponding portion of locking member 35 comprises a straight section between opening 57 and the junction with leg 60. The curved edges 53' and 55' and curved leg 58' caused the locking member 35' to have greater structural integrity than locking member 35. This greater integrity makes it more difficult to defeat the projection afforded by use of such locking members. That is, a greater force is required to break or otherwise damage the locking member 35' by the use of brute force as compared with locking member 35. Hereinafter, references to locking member 35 shall be understood to apply in a like manner to locking member 35'.

Figure 12:
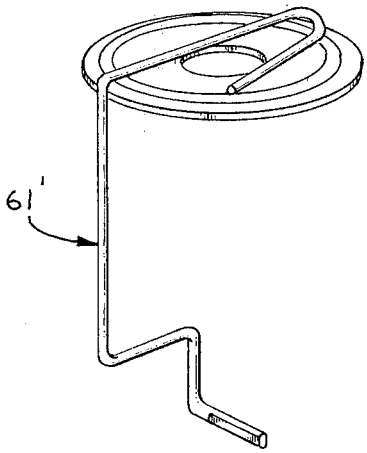
FIG. 12 is a perspective view of a preferred embodiment of the tool used to disengage the locking member.

As shown in shadow line in FIGS. 2 and 6 and 7, a tool 61 adapted to engage hook 59 can pull locking member 35, hence stop flange 51, in a vertical direction away from spokes 49 thereby enabling removal of the actuator 15 and latching post 27 from the housing 13 by unscrewing the actuator. A perspective view of the preferred embodiment of tool 61 is shown in FIG. 12.

Figure 11:
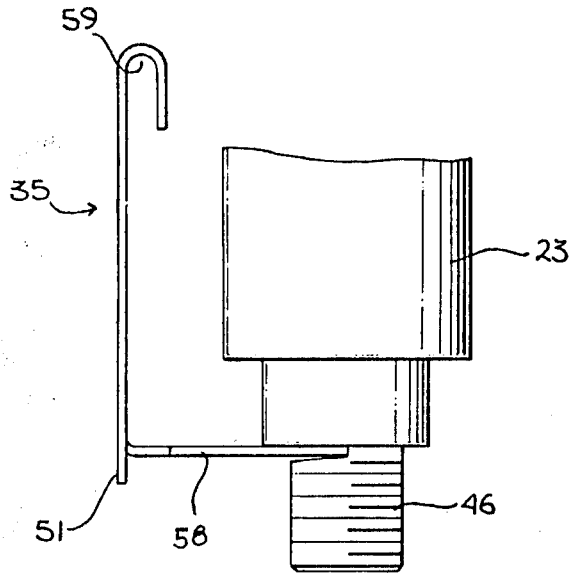
FIG. 11 is a partial elevation view of the latching post showing an alternate embodiment of a means for coupling the locking member to the latching post.

Normally, locking member 35 is held in place between a flange adjacent the threaded end of latching post 27 and hub 47. However, when the actuator and latching post are removed from the housing, hub 47 can no longer hold locking member 35 in place and the action of the resilient tubular portion 23 will force the locking member off the threaded end 46 of latching post 27. Although the locking member can be replaced on the threaded end, the resiliency of tubular portion 23 can make such task difficult and time consuming. Therefore, in an alternative embodiment of the subject invention, securing means may be provided to secure locking member 35 to latching post 27 such that the action of hub 47 need not be depended on to hold the locking member in place. One such securing means is illustrated in FIG. 10 wherein the locking member 35 is coupled to latching post 27 by lock washer 63. Other possible securing means, as shown in FIG. 11, include cutting a hole or slot into threaded end 46 of latching post 27 and inserting the horizontally disposed leg 58 of locking member 35 into such hole or slot. The hole or slot may extend partially or completely through the threaded stem. If the hole or slot extends through the stem, a projection on, or increase in diameter of, the horizontally disposed leg 58 can prevent the leg from being inserted too far into the hole or slot. The horizontally disposed leg 58 should fit snugly within the hole or slot. Of course, once the latching post 27 and housing 13 are threadedly engaged, the side walls of the housing will prevent lateral movement of the locking member away from latching post 27. Additionally, the locking member 35 may be made integral with the latching post such as by welding the two parts together.

Thus, an improved self-contained drain valve has been described. It will be obvious to those skilled in the art that various changes may be made in the design of the drain valve itself as well as in the locking member and means for engaging the locking member during rotation of the actuator and latching means without departing from the spirit and scope of the invention as disclosed and claimed herein.

We claim:

1. In a drain valve for selectively sealing a conduit, said drain valve having a drain housing with a first sealing surface, latching means removably coupled to said drain housing for releasably latching and holding a second sealing surface in sealing relationship with said first sealing surface, whereby fluid is prevented from flowing through said drain valve into said conduit when said sealing surfaces are in said sealing relationship, and actuator means coupled to said latching means, for transmitting force to latch and unlatch said latching means, the improvement comprising:

locking means for preventing said latching means from being disengaged from said housing, wherein said locking means is comprised of a locking member coupled to said latching means, said locking member having means for receiving a tool adapted for insertion into said drain valve, through an end thereof adjacent said first and second sealing surfaces, for releasing said locking member, thereby allowing the disengagement of said latching means from said drain housing.

2. The drain valve defined by claim 1 wherein said said locking member has a flange disposed on a first leg of said locking member, said flange having a first edge on a first side thereof and a second edge on a second side thereof, said drain housing having means for engaging said flange during rotation in a first direction of said actuator means, whereby rotation of said actuator means causes rotation of said latching means and said locking member, and said first edge of said flange rides over said engaging means during rotation in a second direction of said actuator means, and during rotation in said first direction of said actuator means, said second edge of said flange engages said engaging means preventing further rotation in said first direction of said actuator means.

3. The drain valve defined by claim 2 wherein said first edge is rounded and said second edge is flat.

4. The drain valve defined by claim 2 where said first edge and said second edge are curved.

5. The drain valve defined by claim 2 wherein said engaging means comprises at least one spoke extending radially from the interior side wall of said drain housing.

6. The drain valve defined by claim 2 wherein said locking member has a second leg coupled to said latching means and disposed in approximately perpendicular relationship to said first leg, wherein said second leg comprises a curved section between said first leg and said latching means.

7. The drain valve defined by claim 2 wherein said engaging means comprises a grid disposed within said drain housing.

8. The drain valve defined by claim 2 wherein said locking member comprises a stiffly resilient material whereby the shape of said locking member is substantially maintained after engagement and disengagement of said latching means from said drain housing.

9. The drain valve defined by claim 2 wherein said locking member is coupled to said latching means by engagement of said latching means and said drain housing.

10. The drain valve defined by claim 2 wherein said locking member is coupled to said latching means by a lock washer disposed adjacent said locking member and coupled to said latching means.

11. The drain valve defined by claim 2 wherein said locking member is coupled to said latching means by inserting a portion of said locking member into an opening in said latching means.

12. The drain valve defined by claim 2 wherein said locking member is approximately L-shaped.

13. A drain valve comprising:

(a) a drain housing with a first sealing surface;

(b) latching means threadedly coupled to said drain housing for releasable latching and holding a second sealing surface in sealing relationship with said first sealing surface;

(c) actuator means coupled to said latching means for transmitting force to latch and unlatch said latching means;

(d) locking means for preventing threaded disengagement of said latching means from said drain housing, said locking means being comprised of a locking member coupled to said latching means, said locking member having means for receiving a tool adapted for insertion into said drain valve, through an end thereof adjacent said first and second sealing surfaces, for releasing said locking member, thereby allowing the threaded disengagement of said latching means from said drain housing.

14. The drain valve defined by claim 13 wherein said locking member has a flange disposed on a leg of said locking member, said flange having a first edge on a first side thereof and a second edge on a second side thereof, said drain housing having means for engaging said flange during rotation in a first direction of said actuator means, whereby rotation of said actuator means causes rotation of said latching means and said locking member, and said first edge of said flange rides over said engaging means during rotation in a second direction of said actuator means, and during rotation in said first direction of said actuator means, said second edge of said flange engages said engaging means preventing further rotation in said first direction of said actuator means.

15. The drain valve defined by claim 14 where said first edge is rounded and said second edge is flat.

16. The drain valve defined by claim 14 wherein said first edge and second second edge are curved.

17. The drain valve defined by claim 14 wherein said locking member has a second leg coupled to said latching means and disposed in approximately perpendicular relationship to said first leg, wherein said second leg comprises a curved section between said first leg and said latching means.

18. The drain valve defined by claim 13 wherein said locking member comprises a stiffly resilient material whereby the shape of said locking member is substantially maintained after engagement and disengagement of said latching means from said drain housing.

* * * * *